US011505954B2

(12) United States Patent
Goedeke

(10) Patent No.: US 11,505,954 B2
(45) Date of Patent: Nov. 22, 2022

(54) TOOL DEVICE FOR REINFORCEMENT MESH IN CONCRETE AND RELATED METHODS

(71) Applicant: Philip Goedeke, Mims, FL (US)

(72) Inventor: Philip Goedeke, Mims, FL (US)

( * ) Notice: Subject to any disclaimer, the term of this patent is extended or adjusted under 35 U.S.C. 154(b) by 297 days.

(21) Appl. No.: 16/858,938

(22) Filed: Apr. 27, 2020

(65) Prior Publication Data

US 2020/0340260 A1 Oct. 29, 2020

Related U.S. Application Data

(60) Provisional application No. 62/839,118, filed on Apr. 26, 2019.

(51) Int. Cl.

| | |
|---|---|
| ***E04G 21/12*** | (2006.01) |
| ***E04C 5/16*** | (2006.01) |
| ***E04C 5/04*** | (2006.01) |

(52) U.S. Cl.

CPC ..... *E04G 21/12* (2013.01); *E04C 5/04* (2013.01); *E04C 5/166* (2013.01)

(58) Field of Classification Search

CPC . E04G 21/12; E04F 21/20; E04C 5/04; E04C 5/166

See application file for complete search history.

(56) References Cited

U.S. PATENT DOCUMENTS

| | | | | |
|---|---|---|---|---|
| 3,830,032 A | | 8/1974 | Robb | |
| 4,191,360 A | | 3/1980 | Morrison | |
| 5,022,632 A | * | 6/1991 | Beideck | E01F 9/60 254/132 |
| 5,501,496 A | * | 3/1996 | Ramos | E04G 21/169 294/26 |
| 5,727,831 A | | 3/1998 | Dritlein, Jr. | |
| D657,218 S | * | 4/2012 | Wilder | D8/51 |
| 8,465,004 B1 | * | 6/2013 | Fly | B25B 27/02 111/95 |
| D749,814 S | * | 2/2016 | Hurren | D34/28 |
| 9,624,081 B1 | * | 4/2017 | Gloster | B66F 15/00 |
| 10,351,404 B1 | * | 7/2019 | Sanford | B66F 15/00 |
| 2018/0023299 A1 | * | 1/2018 | Edwards | E04C 5/206 52/687 |
| 2018/0163403 A1 | * | 6/2018 | McCarthy | E04C 5/166 |
| 2019/0292767 A1 | * | 9/2019 | Pfaff | E04B 2/86 |
| 2020/0340260 A1 | * | 10/2020 | Goedeke | E04G 21/12 |

OTHER PUBLICATIONS

"Rebar Lifter Hook" Kraft Tool Company; https://www.krafttool.com/products/by-category/concrete/rebar-benders-accessories/by-sku/GG635; retrieved from internet Feb. 11, 2019; pp. 3.

* cited by examiner

*Primary Examiner* — Paola Agudelo

(74) *Attorney, Agent, or Firm* — Allen, Dyer, Doppelt + Gilchrist, PA

(57) ABSTRACT

A tool device is for positioning a reinforcement mesh for concrete. The tool device may include a lever arm having a first end, a second end opposite the first end, and a pivot point between the first end and the second end. The tool device may include a pivoting vertical support coupled to the lever arm at the pivot point and cooperating with the pivot point to rotate about the pivot point, and a toe coupled to the first end of the lever arm and to engage the reinforcement mesh.

20 Claims, 5 Drawing Sheets

TOOL DEVICE FOR REINFORCEMENT MESH IN CONCRETE AND RELATED METHODS

RELATED APPLICATION

This application is based upon prior filed Application No. 62/839,118 filed Apr. 26, 2019, the entire subject matter of which is incorporated herein by reference in its entirety.

TECHNICAL FIELD

The present disclosure relates to the field of construction, and, more particularly, to a construction tool and related methods.

BACKGROUND

In construction, concrete is a ubiquitous building material that dates back to ancient times. Indeed, some of the most famous ancient Roman structures were concrete based (e.g. the Pantheon, the Coliseum). This long running popularity of concrete is because the building material provides desirable strength, and the base materials to form it are readily available worldwide.

In particular, the compressive strength of concrete is quite good. On the other hand, the tensile strength of concrete is rather weak, i.e. the ability to resist elongating forces. To address this issue, it is common to reinforce concrete with a material that has good tensile strength, such as steel (e.g. steel reinforced concrete). The form of the steel reinforcement depends on the application. For example, for concrete walls, steel rebar elongate pieces are used, and for concrete floors or slabs, steel mesh wire frames are used.

SUMMARY

Generally, a tool device is for positioning a reinforcement mesh for concrete. The tool device may include a lever arm having a first end, a second end opposite the first end, and a pivot point between the first end and the second end. The tool device may comprise a pivoting vertical support coupled to the lever arm at the pivot point and cooperating with the pivot point to rotate about the pivot point, and a toe coupled to the first end of the lever arm and to engage the reinforcement mesh. Advantageously, the tool device may readily manipulate and position the reinforcement mesh while pouring concrete.

In some embodiments, the lever arm may comprise a base extending longitudinally and partially between the first end and the second end. The pivoting vertical support may comprise a slotted first end to receive the pivot point, and a second flanged end opposite the slotted first end. The slotted first end may comprise a first longitudinal arm, and a second longitudinal arm defining a slot therebetween. The first longitudinal arm may comprise a first transverse opening, and the second longitudinal arm may comprise a second transverse opening aligned with the first transverse opening.

Also, the pivot point may comprise a passageway to be aligned with the first transverse opening and the second transverse opening, and a pin extending through the first transverse opening, the second transverse opening, and the passageway. The toe may comprise an arm extending from the first end of the lever arm, and a plate coupled to the arm and canted with respect to a longitudinal axis of the lever arm. The plate may be canted with respect to the longitudinal axis of the lever arm at an angle within the range of 30°-55°, for example. The tool device may also include a hand grip coupled to the second end of the lever arm.

Yet another aspect is directed to a method for making a tool device for positioning a reinforcement mesh for concrete. The method may include forming a lever arm having a first end, a second end opposite the first end, and a pivot point between the first end and the second end. The method may further include coupling a pivoting vertical support to the lever arm at the pivot point and cooperating with the pivot point to rotate about the pivot point. The method may comprise coupling a toe to the first end of the lever arm and to engage the reinforcement mesh.

DETAILED DESCRIPTION

Figure 1:
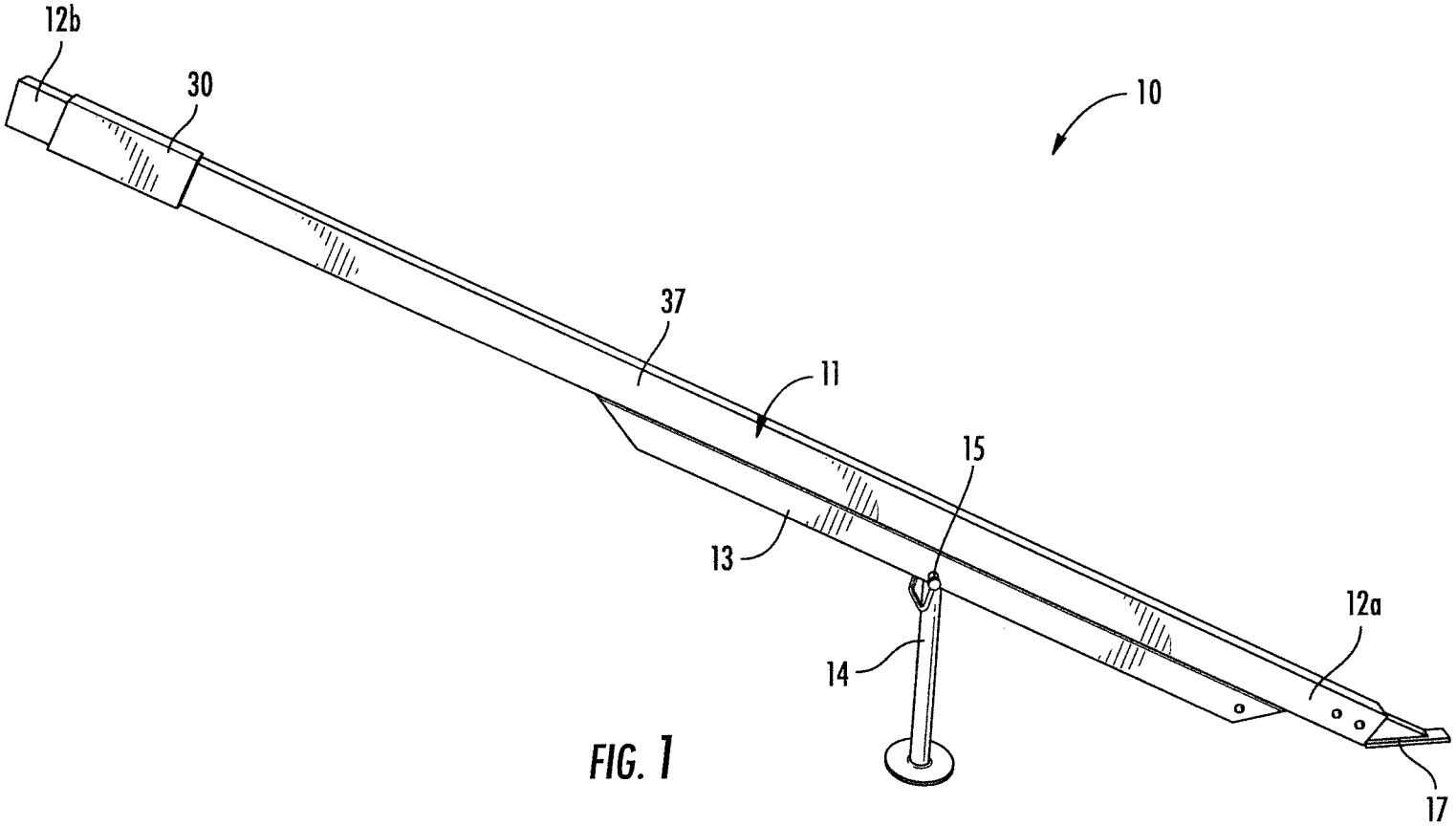
FIG. 1 is a perspective schematic view of a tool device, according to the present disclosure.

The present disclosure will now be described more fully hereinafter with reference to the accompanying drawings, in which several embodiments of the invention are shown. This present disclosure may, however, be embodied in many different forms and should not be construed as limited to the embodiments set forth herein. Rather, these embodiments are provided so that this disclosure will be thorough and complete, and will fully convey the scope of the present disclosure to those skilled in the art. Like numbers refer to like elements throughout.

Referring to FIGS. 1-4, a tool device 10 according to the present disclosure is now described. The tool device 10 illustratively is for manipulating a reinforcement mesh for concrete. In particular, when forming a slab of concrete with reinforcement mesh embedded therein, there is a desire to control a depth of the reinforcement mesh within the formed concrete, and most commonly, to lift the reinforcement mesh. In past approaches, the reinforcement mesh was lifted by hand or using cumbersome tools. The tool device 10 disclosed herein provides an approach to this issue.

The tool device 10 illustratively includes a lever arm 11 having a first end 12*a* and a second end 12*b* opposing the first end, and a support base 13 coupled to the lever arm and extending longitudinally with the lever arm. The tool device 10 illustratively includes a support 14 coupled to the support base 13 at a pivot point 15 and configured to pivotally rotate about the pivot point. The support 14 is configured to freely pivot across an angular range of approximately 170° (±10°). The tool device 10 illustratively includes a toe 17 coupled to the first end 12*a* of the lever arm 11 and configured to engage and lift the reinforcement mesh.

The second end 12*b* of the lever arm 11 is configured to be hand manipulated by user. Although in the depicted embodiment, the lever arm 11 has a rectangle cross-sectional shape. In some embodiments, the lever arm 11 has an oval or circle cross-sectional shape, which provides greater user comfort for repetitive use during large concrete jobs. In some embodiments, the second end 12*b* of the lever arm 11 comprises a hand grip 30, which may comprise a cushioned or soft material.

Figure 2:
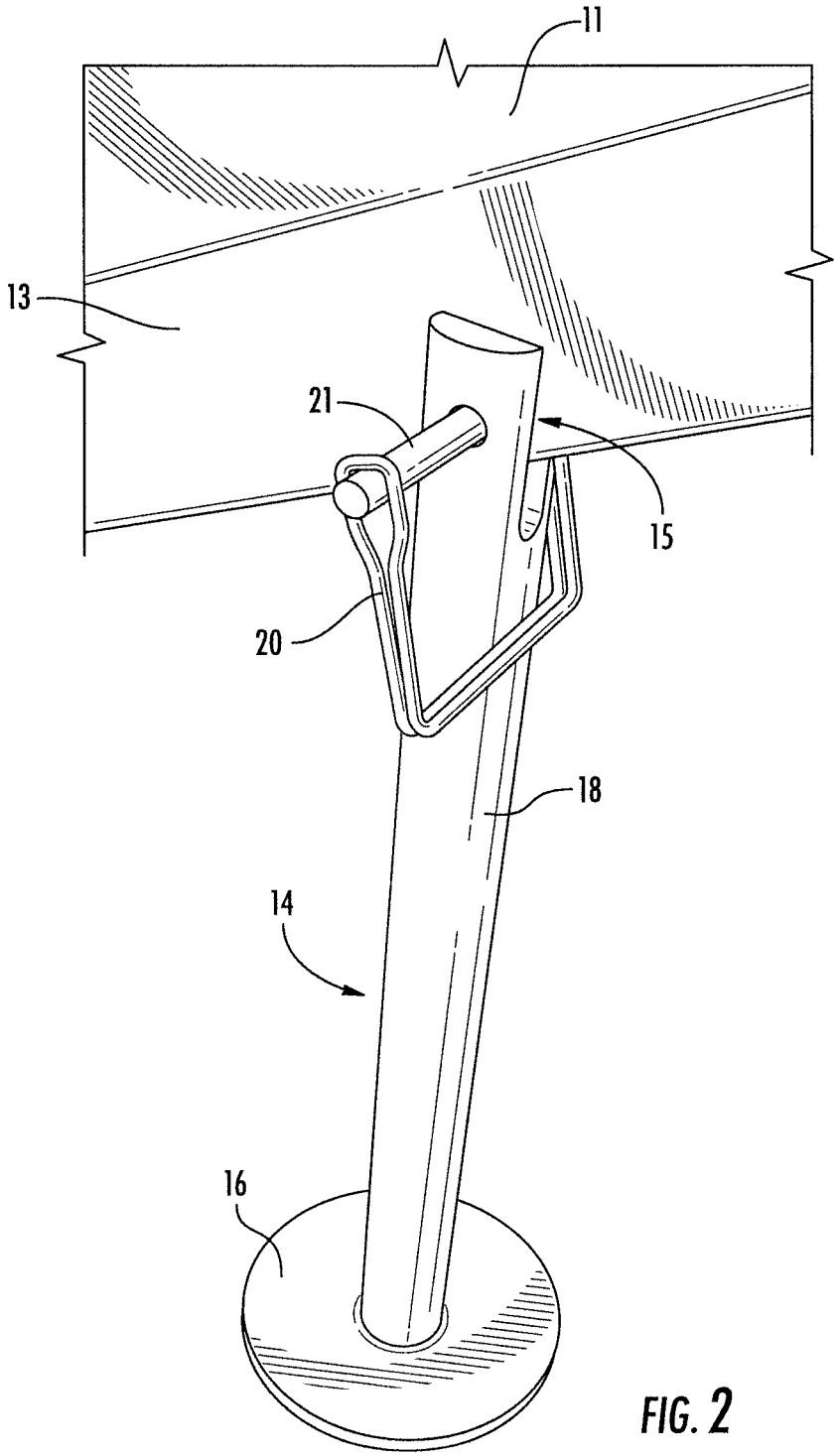
FIG. 2 is a perspective schematic view of a pivot point and a pivoting vertical support of the tool device of FIG. 1.

As perhaps best seen in FIG. 2, the support 14 illustratively comprises a support member 18, and a foot 16 coupled to a distal end of the support member. The support member 18 illustratively has a circle cross-sectional shape, but could have other shapes in other embodiments. The foot 16 is illustratively circle-shaped, but may comprise other shapes, such a rectangle shape. The proximal end of the support member 18 is coupled to the pivot point 15.

The proximal end of the support member 18 comprises a U-shaped longitudinal recess defining opposing arms configured to be fit over the pivot point 15, and a first transverse passageway extending through the arms. The pivot point 15 illustratively includes a second transverse passageway extending between opposing sides of the support base 13. The support 14 illustratively comprises a pin 21 extending through the aligned first and second transverse passageways and configured to retain the arm to the support base 13. The support 14 illustratively comprises a clip 20 configured to retain the pin 21 in the aligned first and second transverse passageways during operation.

Figure 3:
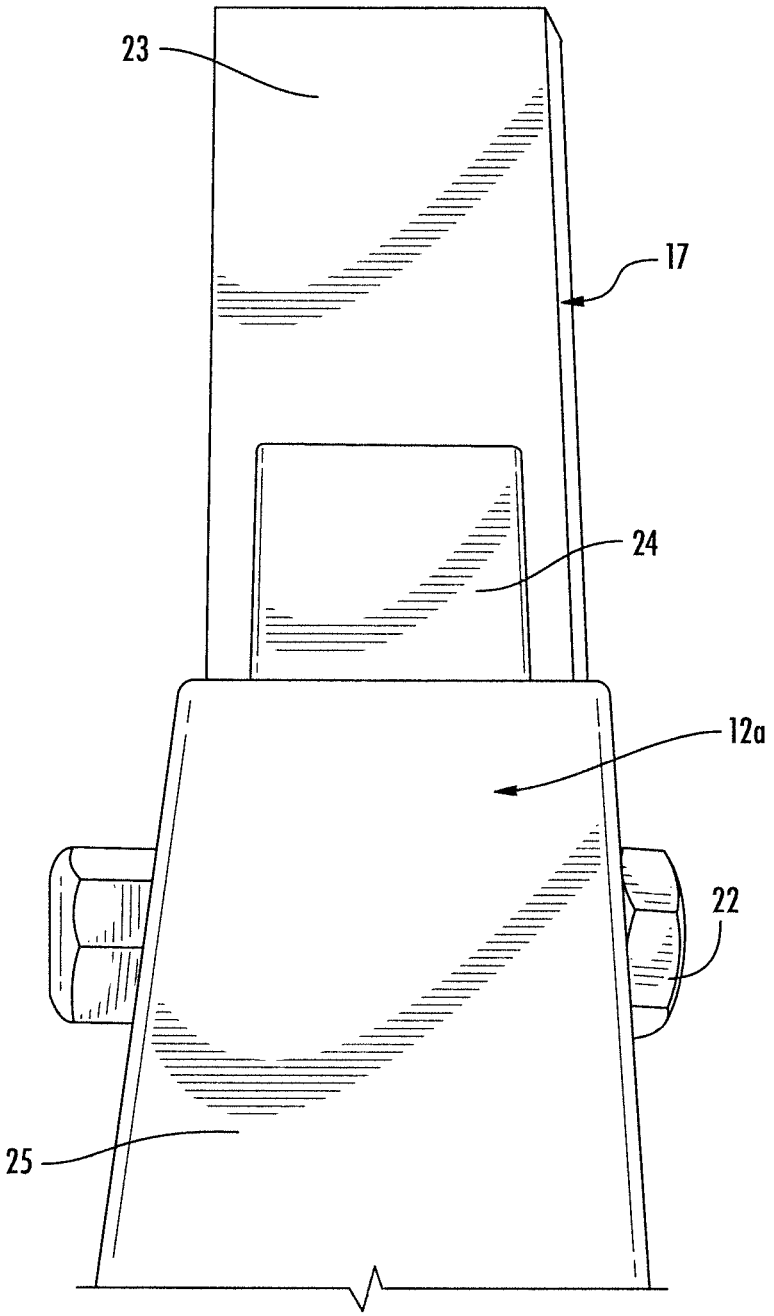
FIG. 3 is a top plan schematic view of a toe of the tool device of FIG. 1.
Figure 4:
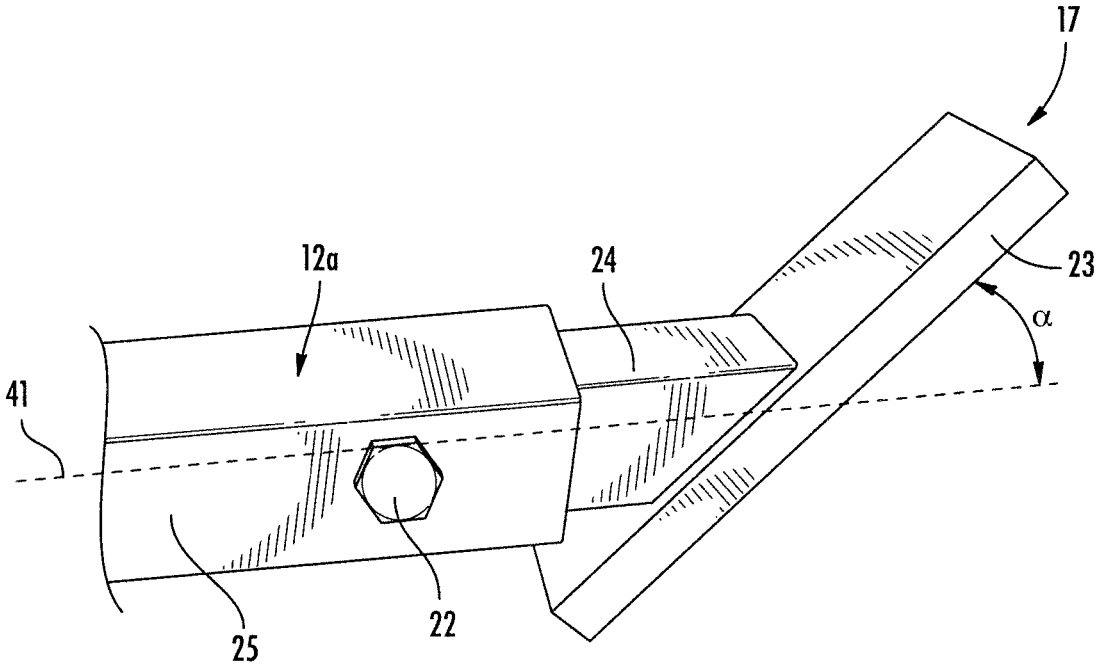
FIG. 4 is a side schematic view of the toe of the tool device of FIG. 1.

As perhaps best seen in FIGS. 3-4, the first end 12*a* of the lever arm 11 comprises a tubular housing 25 defining a longitudinal passageway. The toe 17 illustratively includes a tubular base 24 to be received by the longitudinal passageway of the tubular housing 25. The first end 12*a* of the lever arm 11 comprises a transverse fastener 22 extending through opposing recesses in the tubular housing 25 and the tubular base 24 to couple them together. The toe 17 illustratively comprises a plate 23 coupled to the tubular base 24 opposite the tubular housing 25 and configured to lift the reinforcement mesh for concrete. The plate 23 illustratively comprises a rectangle-shape, but could comprise other shapes that taper towards a distal end of the plate (e.g. triangle or trapezoid shaped). The plate 23 illustratively is canted with respect to a longitudinal axis of the tubular housing 25 at approximately 30° (±20°).

Another aspect is directed to a method for making a tool device 10 for manipulating a reinforcement mesh for concrete. The method includes forming a lever arm 11 having a first end 12*a* and a second end 12*b* opposing the first end, coupling a support base 13 to the lever arm and to extend longitudinally with the lever arm, and coupling a support 14 coupled to the support base at a pivot point 15 and configured to pivotally rotate about the pivot point. The method includes coupling a toe 17 to the first end 12*a* of the lever arm 11 and configured to engage and lift the reinforcement mesh.

The tool device 10 is used to lift the reinforcement mesh during pouring of concrete slabs. In particular, the toe 17 of the tool device 10 is inserted into an opening of the reinforcement mesh. Using the second end 12*b* of the lever arm 11, the lever arm is pivoted about the pivot point 15 to readily lift the toe 17 and the coupled reinforcement mesh. Because of the pivoting action, the toe 17 maintains a solid coupling to the reinforcement mesh. This is contrast to existing approaches, such as disclosed in U.S. Pat. No. 4,191,360 to Morrison. Moreover, the support base 13 of the tool device 10 provides structure rigidity to prevent bowing of the lever arm 11 during lifting of the reinforcement mesh.

Referring again to FIGS. 1-3, a tool device 10 is for positioning a reinforcement mesh for concrete. The tool device 10 illustratively includes a lever arm 11 having a first end 12*a*, a second end 12*b* opposite the first end, and a pivot point 15 between the first end and the second end. The tool device 10 illustratively comprises a pivoting vertical support 14 coupled to the lever arm 11 at the pivot point 15 and cooperating with the pivot point to rotate about the pivot point.

The tool device 10 comprises a toe 17 coupled to the first end 12*a* of the lever arm 11 and to engage the reinforcement mesh. In the illustrated embodiment, the lever arm 11 comprises an upper body 37, and a base 13 extending longitudinally and partially between the first end 12*a* and the second end 12*b*. The base 13 provides structural rigidity to resist bending and bowing of the upper body 37 of the lever arm 11 during use.

Figure 5:
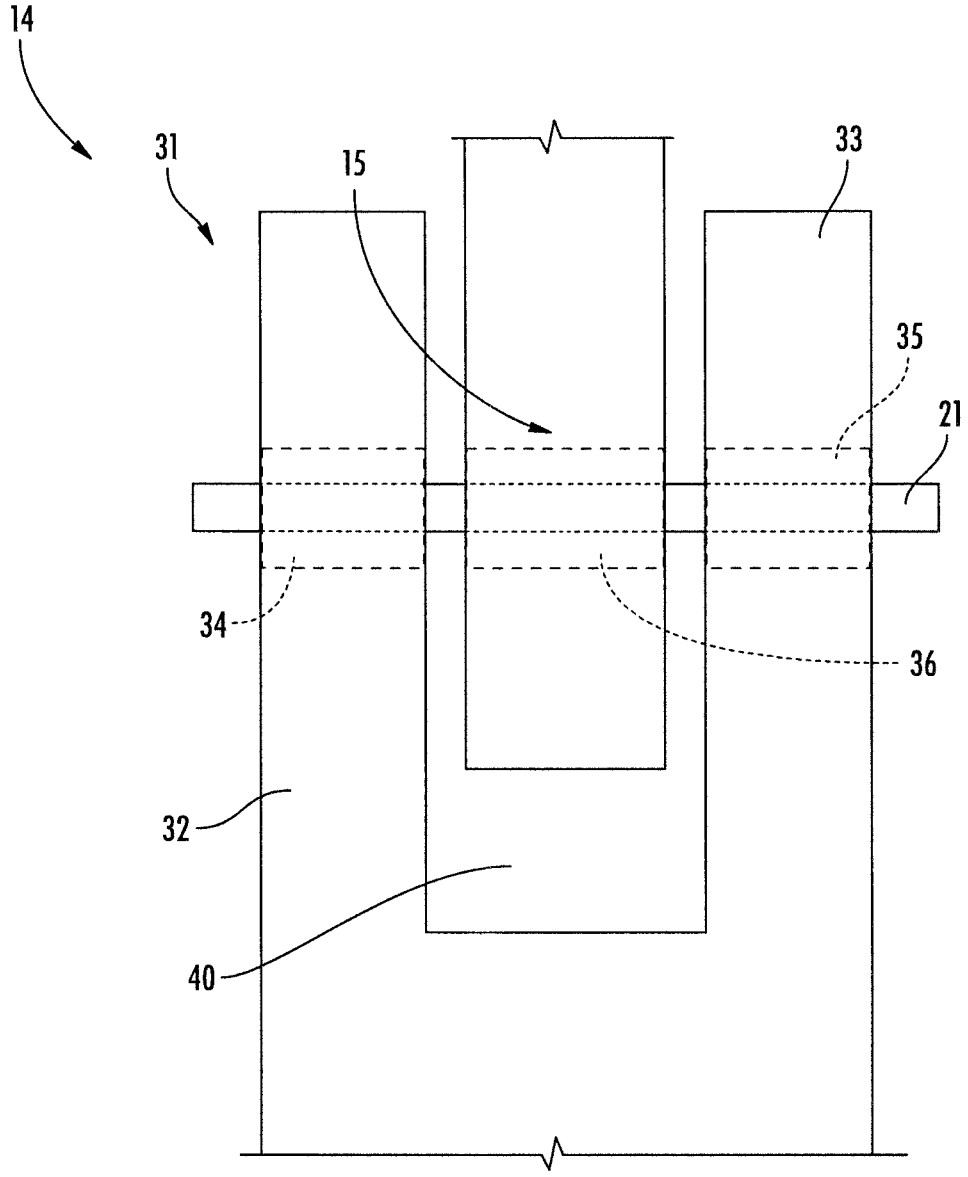
FIG. 5 is a partial side schematic view of the pivoting vertical support of the tool device of FIG. 1.

As perhaps best seen in FIGS. 2 & 5, the pivoting vertical support 14 comprises a slotted first end 31 to receive the pivot point 15, and a second flanged end (i.e. the foot 16) opposite the slotted first end. In some embodiments, the second flanged end comprises a textured bottom surface to more securely anchor the tool device 10.

The slotted first end 31 illustratively includes a first longitudinal arm 32, and a second longitudinal arm 33 substantially parallel (i.e. ±10° of parallel) to the first longitudinal arm and defining a slot 40 therebetween. The first longitudinal arm 32 comprises a first transverse opening 34, and the second longitudinal arm 33 comprises a second transverse opening 35 aligned with the first transverse opening. Also, the pivot point 15 comprises a passageway 36 to be aligned with the first transverse opening 34 and the second transverse opening 35, and a pin 21 extending through the first transverse opening, the second transverse opening, and the passageway and coupling them together.

As perhaps best seen in FIG. 4, the toe 17 comprises an arm (i.e. the tubular base 24) extending from the first end 12*a* of the lever arm 11, and a plate 23 coupled to the arm and canted with respect to a longitudinal axis 41 of the lever arm. The plate 23 is canted with respect to the longitudinal axis of the lever arm at an angle $\alpha$ within the range of 30°-55°, for example. The tool device 10 also includes a hand grip 30 coupled to the second end 12*b* of the lever arm 11.

The first end 12*a* of the lever arm 11 comprises a transverse fastener 22 extending through opposing recesses in the tubular housing 25 and the arm to couple them together. The arm may include a plurality aligned openings to permit longitudinal extension and retraction of the toe 17. In the illustrated embodiment, the transverse fastener 22 comprises a threaded screw and threaded nut fastener. In other embodiments, the transverse fastener 22 may comprise a push button arrangement, i.e. a push button telescoping pole, for easy and quick adjustment.

In the illustrated embodiment, the plate 23 is flat, but in other embodiments, the plate may be curved upward toward a most distal end of the toe, or have an L-shaped distal end, thereby urging retention of the concrete mesh. In some embodiments, the plate 23 is removably coupled to the arm via a mechanical interlocking arrangement. Here, the plate 23 may be swapped out depending on the current application. For example, the flat plate 23 of the illustrated embodiment could be swapped out for a curved or L-shaped version.

Yet another aspect is directed to a method for making a tool device 10 for positioning a reinforcement mesh for concrete. The method includes forming a lever arm 11 having a first end 12*a*, a second end 12*b* opposite the first end, and a pivot point 15 between the first end and the second end. The method includes coupling a pivoting vertical support 14 to the lever arm 11 at the pivot point 15 and cooperating with the pivot point to rotate about the pivot point. The method comprises coupling a toe 17 to the first end 12*a* of the lever arm 11 and to engage the reinforcement mesh.

Many modifications and other embodiments of the present disclosure will come to the mind of one skilled in the art having the benefit of the teachings presented in the foregoing descriptions and the associated drawings. Therefore, it is understood that the present disclosure is not to be limited to the specific embodiments disclosed, and that modifications and embodiments are intended to be included within the scope of the appended claims.

That which is claimed is:

1. A tool device for positioning a reinforcement mesh for concrete, the tool device comprising:

a lever arm comprising a tubular housing defining a longitudinal passageway therein, said lever arm having a first end, a second end opposite said first end, and a pivot point between said first end and said second end;

a pivoting vertical support coupled to said lever arm at said pivot point and cooperating with said pivot point to rotate about said pivot point; and a toe coupled to said first end of said lever arm and to engage the reinforcement mesh, said toe comprising a tubular base within the longitudinal passageway of said tubular housing and extending from said first end of said lever arm, and a plate coupled to said tubular base and canted with respect to a longitudinal axis of said lever arm, the plate having a tapered distal end.

2. The tool device of claim 1 wherein said lever arm comprises a base extending longitudinally and partially between said first end and said second end.

3. The tool device of claim 1 wherein said pivoting vertical support comprises a slotted first end to receive said pivot point, and a second flanged end opposite said slotted first end.

4. The tool device of claim 3 wherein said slotted first end comprises a first longitudinal arm, and a second longitudinal arm defining a slot therebetween.

5. The tool device of claim 4 wherein said first longitudinal arm comprises a first transverse opening; and wherein said second longitudinal arm comprises a second transverse opening aligned with said first transverse opening.

6. The tool device of claim 5 wherein said pivot point comprises a passageway to be aligned with said first transverse opening and said second transverse opening, and a pin extending through said first transverse opening, said second transverse opening, and said passageway.

7. The tool device of claim 3 wherein the second flanged end comprises a circular shaped foot.

8. The tool device of claim 1 wherein said plate is canted with respect to the longitudinal axis of said lever arm at an angle within the range of 30°-55°.

9. The tool device of claim 1 further comprising a hand grip coupled to said second end of said lever arm.

10. A tool device for positioning a reinforcement mesh for concrete, the tool device comprising:

a lever arm comprising a tubular housing defining a longitudinal passageway therein, said lever arm having a first end, a second end opposite said first end, and a pivot point between said first end and said second end;

a base extending longitudinally and partially between said first end and said second end;

a pivoting vertical support coupled to said lever arm at said pivot point and cooperating with said pivot point to rotate about said pivot point;

a hand grip coupled to said second end of said lever arm; and a toe coupled to said first end of said lever arm and to engage the reinforcement mesh, said toe comprising a tubular base within the longitudinal passageway of said tubular housing and extending from said first end of said lever arm, and a plate coupled to said tubular base and canted with respect to a longitudinal axis of said lever arm, the plate having a tapered distal end.

11. The tool device of claim 10 wherein said pivoting vertical support comprises a slotted first end to receive said pivot point, and a second flanged end opposite said slotted first end.

12. The tool device of claim 11 wherein said slotted first end comprises a first longitudinal arm, and a second longitudinal arm defining a slot therebetween.

13. The tool device of claim 12 wherein said first longitudinal arm comprises a first transverse opening; and wherein said second longitudinal arm comprises a second transverse opening aligned with said first transverse opening.

14. The tool device of claim 13 wherein said pivot point comprises a passageway to be aligned with said first transverse opening and said second transverse opening, and a pin extending through said first transverse opening, said second transverse opening, and said passageway.

15. The tool device of claim 10 wherein said plate is canted with respect to the longitudinal axis of said lever arm at an angle within the range of 30°-55°.

16. The tool device of claim 11 wherein the second flanged end comprises a circular shaped foot.

17. A method for making a tool device for positioning a reinforcement mesh for concrete, the method comprising:

forming a lever arm comprising a tubular housing defining a longitudinal passageway therein, the lever arm having a first end, a second end opposite the first end, and a pivot point between the first end and the second end;

coupling a pivoting vertical support to the lever arm at the pivot point and cooperating with the pivot point to rotate about the pivot point; and coupling a toe to the first end of the lever arm and to engage the reinforcement mesh, the toe comprising a tubular base within the longitudinal passageway of the tubular housing and extending from the first end of the lever arm, and a plate coupled to the tubular base and canted with respect to a longitudinal axis of the lever arm, the plate having a tapered distal end.

18. The method of claim 17 wherein the lever arm comprises a base extending longitudinally and partially between the first end and the second end.

19. The method of claim 17 wherein the pivoting vertical support comprises a slotted first end to receive the pivot point, and a second flanged end opposite the slotted first end.

20. The method of claim 19 wherein the slotted first end comprises a first longitudinal arm, and a second longitudinal arm defining a slot therebetween.

* * * * *